US008782973B1

(12) United States Patent
Everingham et al.

(10) Patent No.: US 8,782,973 B1
(45) Date of Patent: Jul. 22, 2014

(54) SKYLIGHT GUARD

(75) Inventors: Kristina M. Everingham, Murfreesboro, TN (US); Thomas G. Coop, Goodlettsville, TN (US)

(73) Assignee: EverCo, LLC, Murfreesboro, TN (US)

( * ) Notice: Subject to any disclaimer, the term of this patent is extended or adjusted under 35 U.S.C. 154(b) by 0 days.

(21) Appl. No.: 13/151,958

(22) Filed: Jun. 2, 2011

(51) Int. Cl.
*E04B 7/18* (2006.01)

(52) U.S. Cl.
USPC ..... 52/200

(58) Field of Classification Search
USPC ..... 52/200, 202, 204.61, 664, 660; 49/50, 49/57
See application file for complete search history.

(56) References Cited

U.S. PATENT DOCUMENTS

| | | | | | |
|---|---|---|---|---|---|
| 445,353 | A | * | 1/1891 | Miles | 52/684 |
| 1,236,008 | A | | 8/1917 | Rysdon | |
| 1,668,564 | A | * | 5/1928 | Jenkins | 52/97 |
| 1,674,211 | A | * | 6/1928 | Loucks | 52/714 |
| 1,715,208 | A | * | 5/1929 | Micklin | 52/507 |
| 2,260,974 | A | * | 10/1941 | Healey et al. | 52/684 |
| 2,317,428 | A | | 4/1943 | Anderson | |
| 2,328,977 | A | | 9/1943 | Hasenburger et al. | |
| 2,851,973 | A | * | 9/1958 | Lenke et al. | 52/200 |
| 3,105,423 | A | * | 10/1963 | Reiland | 52/677 |
| 3,418,777 | A | | 12/1968 | Giles | |
| 3,982,373 | A | | 9/1976 | Wilson | |
| 4,080,763 | A | | 3/1978 | Naidus et al. | |
| 4,117,638 | A | * | 10/1978 | Kidd et al. | 52/200 |
| 4,177,615 | A | | 12/1979 | Anderson | |
| 4,589,238 | A | * | 5/1986 | Sampson et al. | 52/200 |
| 4,637,444 | A | | 1/1987 | Tanner | |
| RE33,566 | E | | 4/1991 | Heckelsberg | |
| 5,046,292 | A | * | 9/1991 | Sampson et al. | 52/200 |
| 5,237,788 | A | | 8/1993 | Sandow | |
| 5,419,090 | A | | 5/1995 | Sandow | |
| 5,765,324 | A | * | 6/1998 | Schultz | 52/200 |
| 5,787,642 | A | | 8/1998 | Coyle et al. | |
| 5,806,255 | A | | 9/1998 | Verby et al. | |
| 6,151,838 | A | * | 11/2000 | Husein | 52/58 |
| 6,199,330 | B1 | | 3/2001 | Cobb | |
| 6,209,271 | B1 | | 4/2001 | Kovacs | |
| 7,134,254 | B1 | | 11/2006 | Van Gelder | |
| 7,634,882 | B1 | | 12/2009 | Briggs et al. | |
| 2005/0086878 | A1 | * | 4/2005 | Feucht et al. | 52/200 |
| 2005/0193644 | A1 | * | 9/2005 | Simpson et al. | 52/91.3 |
| 2006/0162272 | A1 | * | 7/2006 | Phillips et al. | 52/660 |
| 2006/0230694 | A1 | * | 10/2006 | Skov et al. | 52/200 |
| 2008/0115430 | A1 | * | 5/2008 | Feucht et al. | 52/200 |
| 2008/0190050 | A1 | | 8/2008 | McClure | |

* cited by examiner

*Primary Examiner* — Jeanette E Chapman
*Assistant Examiner* — James Buckle, Jr.
(74) *Attorney, Agent, or Firm* — Waddey & Patterson PC; Matthew C. Cox

(57) ABSTRACT

A skylight guard for preventing people or objects from falling through a skylight of a roof panel on a roof provides a wire mesh screen and a plurality of hooks securable to the roof. Each hook includes a hook base, a hook wall and a hook flange. Each hook is securable to the roof using one or more roof fasteners. Each roof fastener can be disposed through a fastener hole predefined in the hook base, and each fastener may also extend through the roof panel into a supporting purlin positioned underneath the roof panel.

5 Claims, 5 Drawing Sheets

SKYLIGHT GUARD

BACKGROUND

1. Technical Field

The present invention relates generally to safety equipment and more particularly to protective guards for use on a roof to cover a skylight and to prevent objects or people from falling through the skylight.

2. Background Art

Skylights are panels that can include a transparent or a translucent sheet of material spanning an opening defined in a roof. Skylights are commonly used to allow light to pass to area housed underneath the roof. Conventional skylights can be used with metal roof panels. In many applications, a roof can include a metal or other rigid material that will readily support the weight of a person walking on the roof. An opening can be formed in the roof material, and a skylight panel of a dissimilar material can be positioned on the roof spanning the opening. Skylights commonly include a plastic material.

One problem associated with skylights occurs when a person positioned on the roof inadvertently steps on, or places a heavy object on, the skylight. This may be due to a variety of reasons, including difficulty in visually identifying the skylight regions on a roof or carelessness. Oftentimes a worker may mistake the skylight for a structurally sound part of the roof and intentionally step on the skylight or place a heavy object onto the skylight. However, because the skylight is generally made of a less rigid material than the roof, the skylight can break due to the weight of the person or object, causing the person or object to fall through the roof panel. Falls of this type can result in serious injury or death to the person or to other persons positioned on the ground below the panel.

Others have attempted to provide structural guards to prevent people or objects from falling through skylights. For example, U.S. Patent Publication No. 2008/0190050 provides a safety reinforced light transmitting panel assembly. Other types of conventional wire screens for guarding skylights are also known in the art. However, such skylight guards are generally adapted for use with curved or arched skylights, and are not compatible with flat panel skylights of the types used with corrugated metal roofing panels. Additionally, conventional skylight guards do not provide adequate strength for preventing falls through the skylight, and many conventional skylights do not comply with modern safety standards.

What is needed then are improvements in the devices and associated methods for preventing persons and objects from falling through skylights.

BRIEF SUMMARY

The present invention generally provides a skylight guard apparatus for covering a skylight on a roof to prevent people or objects from falling through the skylight.

One embodiment of the present disclosure provides an apparatus for covering a skylight on a roof, the roof including a roof panel and a roof panel surface. The roof defines an opening, and the skylight spans the opening. The skylight guard apparatus includes a wire mesh screen having a plurality of longitudinal wire strands. The screen is positioned above the skylight. A first hook including a first hook base is securable to the roof. The first hook includes a first hook wall extending upward from the first hook base, and a first hook flange extends from the first hook wall in a direction generally away from the screen. A second hook includes a second hook base securable to the roof. The second hook includes a second hook wall extending upward from the second hook base, and a second hook flange extends from the second hook wall in a direction generally away from the first hook. A first one of the plurality of longitudinal wire strands is received in the first hook between the first hook base and the first hook flange, and a second one of the plurality of longitudinal wire strands is received in the second hook between the second hook base and the second hook flange.

Yet another embodiment of the present disclosure provides a hook apparatus for securing a wire screen having a plurality of longitudinal wire strands to a roof for covering a skylight. The apparatus includes a hook base having a first base edge and an opposite second base edge. A hook wall extends upward from the first base edge, and a hook flange extends from the hook wall toward the second base edge above the hook base. The hook defines an interior flange corner positioned for receiving one of the plurality of longitudinal wire strands.

A further embodiment of the present disclosure provides a roofing system having a roof including a roof panel defining a roof panel surface. The roof panel defines an opening, and a skylight spans the opening. A wire mesh screen is positioned on the roof over the skylight. The screen includes a plurality of longitudinal wire strands. A first hook is attached to the roof, and a second hook is attached to the roof opposite the first hook. The first hook engages a first one of the plurality of longitudinal wire strands, and the second hook engages a second one of the plurality of longitudinal wire strands. The first and second hooks are separated by a hook separation distance greater than the lateral width of the skylight.

Numerous other objects, features and advantages of the present disclosure will be readily apparent to those skilled in the art upon a reading of the following description when taken in conjunction with the accompanying drawings.

DETAILED DESCRIPTION

Figure 1:
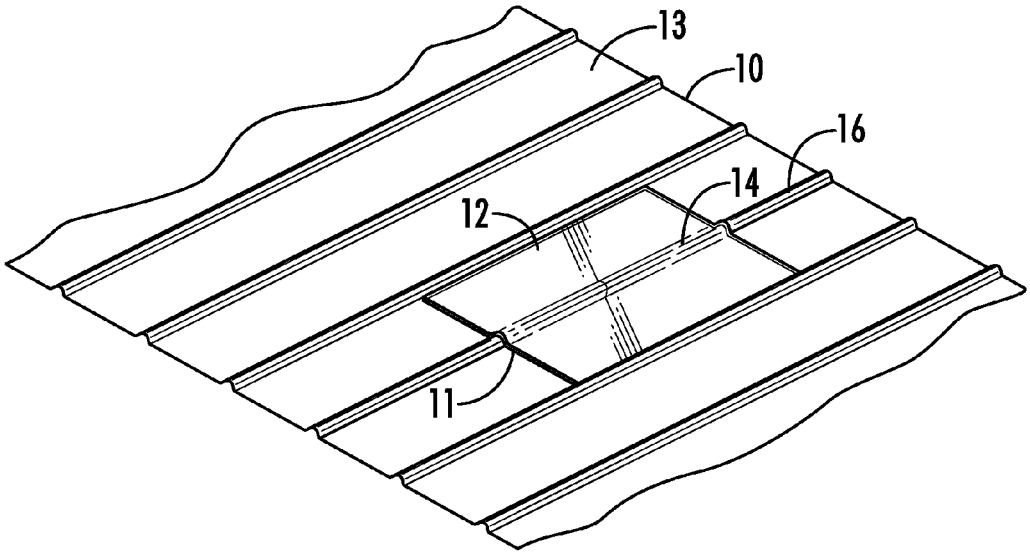
FIG. 1 (PRIOR ART)
FIG. 1 illustrates a perspective view of a prior art roof defining an opening and including a skylight roof panel spanning the opening.
Figure 2:
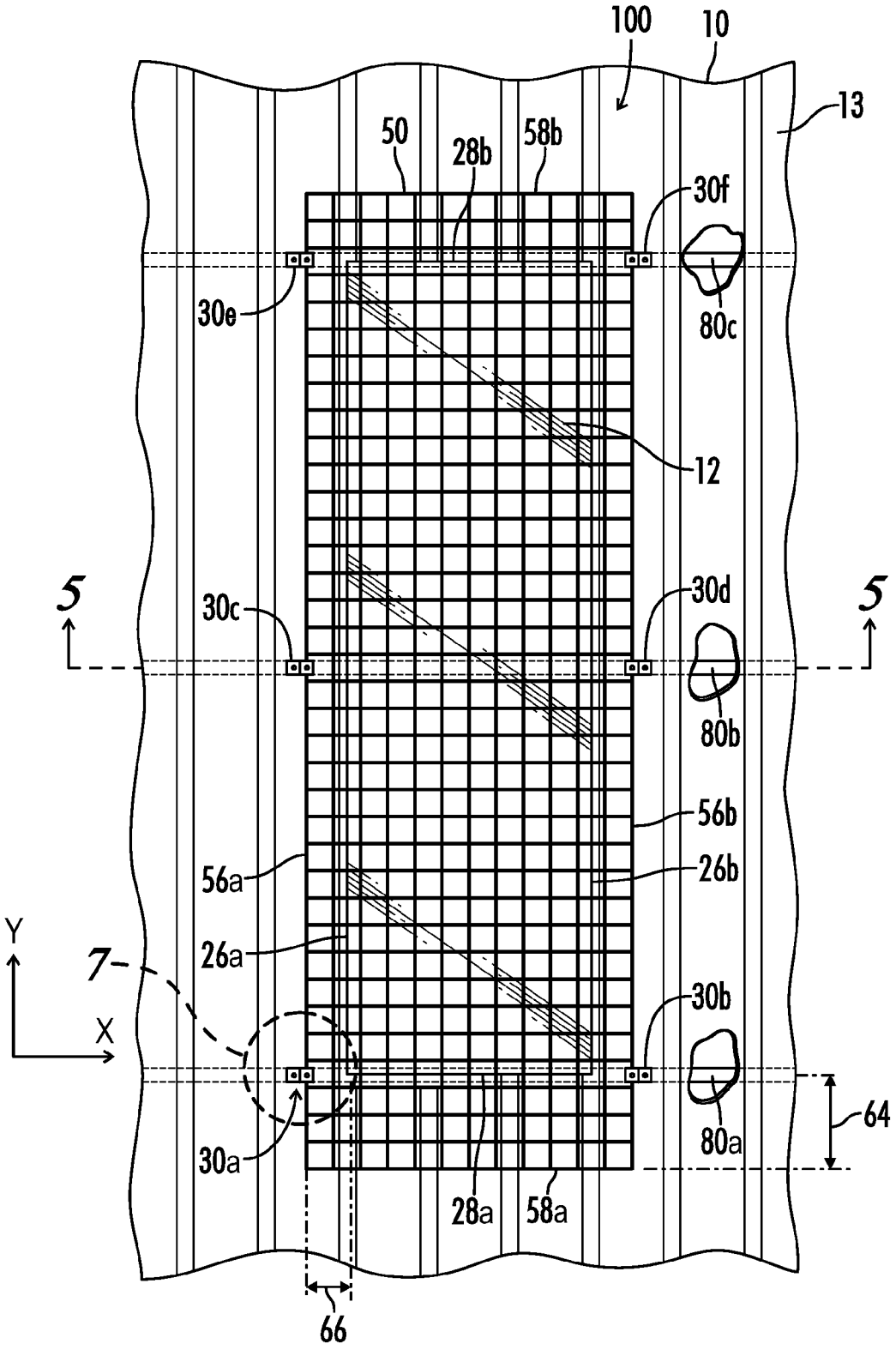
FIG. 2 illustrates a plan view of an embodiment of a skylight guard apparatus positioned over a skylight in accordance with the present disclosure.

Referring now to the drawings and particularly to FIG. 2, an embodiment of a skylight guard is generally illustrated and is designated by the numeral 100. The skylight guard is adapted for covering a skylight 12, as illustrated in FIG. 1. In the drawings, not all reference numbers are included in each drawing, for the sake of clarity. In addition, positional terms such as "upper," "lower," "side," "top," "bottom," "vertical," "horizontal," etc. refer to the apparatus when in the orientation shown in the drawing. The skilled artisan will recognize that a skylight guard, hooks and roofing systems in accordance with the present disclosure can assume different orientations when in use.

Referring now to FIG. 1, a conventional roof 10 can include a roof panel 13. Roof panel 13 can include a corrugated or non-corrugated sheet defining an opening 11. A plurality of modular roof panels 13 can be combined to form a roof 10. A skylight 12 spans roof opening 11. Skylight 12 can include a plastic or non-metallic translucent panel for allowing light to enter the space housed under the roof 10. Skylight 12 can be transparent or non-transparent. Also, skylight 12 can include one or more skylight corrugations 14 positioned and shaped to align with one or more roof corrugations 16. The conventional roof 10 illustrated in FIG. 1 poses a danger to persons working on the roof and also to persons or property positioned below the roof, as a downward load may be inadvertently placed on skylight 12, causing skylight 12 to break and allowing a person or object to fall through the skylight. Roof 10 can include a plurality of skylights 12 in some embodiments.

The present disclosure provides a skylight guard apparatus for covering skylight 12 on a roof 10 to prevent persons or objects from breaking the skylight and passing through the roof opening 11. Referring now to FIG. 2, an embodiment of a skylight guard apparatus 100 for covering a skylight 12 is illustrated in a plan view positioned on a roof 10. The apparatus 100 includes a wire mesh screen 50 positioned above skylight 12. The screen 50 is positioned above the skylight 12 and is secured in place using a plurality of hooks 30*a*, 30*b*, etc.

Skylight 12 and wire mesh screen 50 generally include a longitudinal dimension and a lateral dimension. The longitudinal direction is generally illustrated by the y-axis in FIG. 2, and the lateral direction is generally illustrated by the x-axis in FIG. 2. In some embodiments, the skylight 12 includes a skylight length and a skylight width. The longer of the skylight length and the skylight width extends along the longitudinal direction, as indicated by the y-axis and as illustrated generally in FIG. 2. In such embodiments, skylight 12 includes skylight longitudinal edges 26*a*, 26*b* and skylight lateral edges 28*a*, 28*b*. The skylight longitudinal edges 26*a*, 26*b* are longer than the skylight lateral edges 28*a*, 28*b* in some embodiments.

Similarly, wire screen 50 includes a screen length and a screen width. The longer of the screen length and the screen width extends along the longitudinal direction, as seen in FIG. 2. Wire screen 50 includes screen lateral edges 58*a*, 58*b* and screen longitudinal edges 56*a*, 56*b*.

Figure 9:
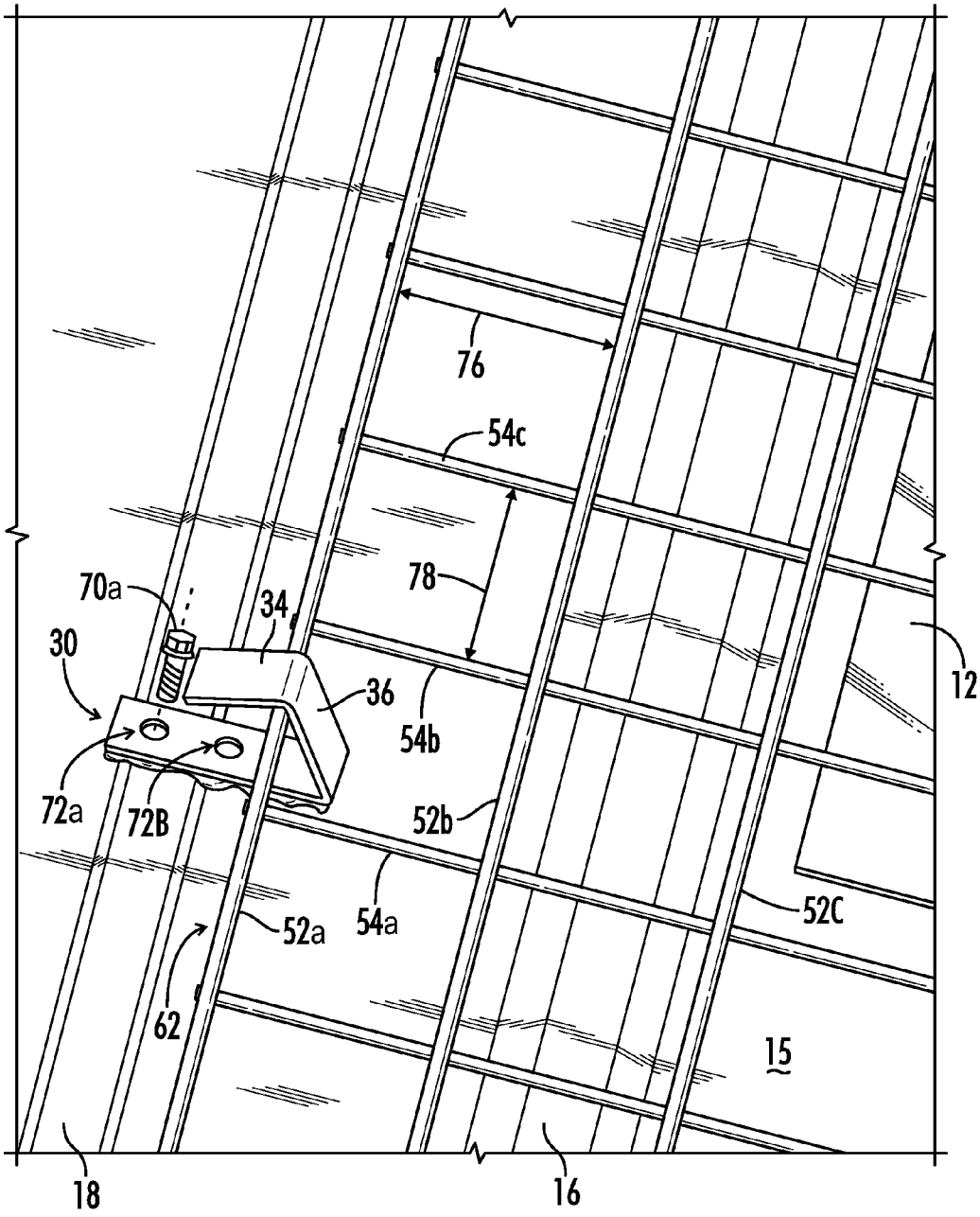
FIG. 9 illustrates a perspective view of a hook and wire mesh screen positioned on a roof in accordance with the present disclosure.

As seen in FIG. 9, wire screen 50 includes a plurality of longitudinal wire strands 52*a*, 52*b*, 52*c*, etc. and a plurality of lateral wire strands 54*a*, 54*b*, 54*c*, etc. Each lateral wire strand 54 can be secured to one or more of the plurality of longitudinal wire strands 52. In some embodiments, each lateral wire strand 54 is spot welded to one or more of the plurality of longitudinal wire strands 52, forming a rectangular grid pattern. It will be readily appreciated by those of skill in the art that wire mesh screen 50 can include a pattern having other curvilinear or non-rectangular polygonal shapes in accordance with the present invention.

Figure 7:
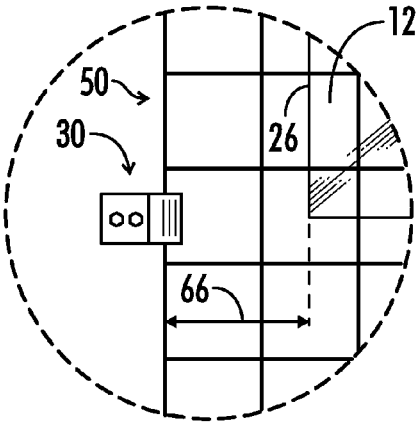
FIG. 7 illustrates a plan view of an embodiment of a hook apparatus of a skylight guard apparatus showing Section 7 from FIG. 2.

Referring again to FIG. 2, in some embodiments, screen 50 includes a lateral screen width greater than lateral skylight width and a longitudinal screen length greater than longitudinal skylight length. As such, a longitudinal edge offset 66 is defined between first skylight longitudinal edge 26*a* and first screen longitudinal edge 56*a*. Longitudinal edge offset 66 is illustrated in an embodiment in FIG. 7. A similar longitudinal edge offset can be defined between second skylight longitudinal edge 26*b* and second screen longitudinal edge 56*b*. Also, in some embodiments, a lateral edge offset 64 is defined between first skylight lateral edge 28*a* and first screen lateral edge 58*a*. A similar lateral edge offset can be defined between second skylight lateral edge 28*b* and second screen lateral edge 58*b*.

Figure 3:
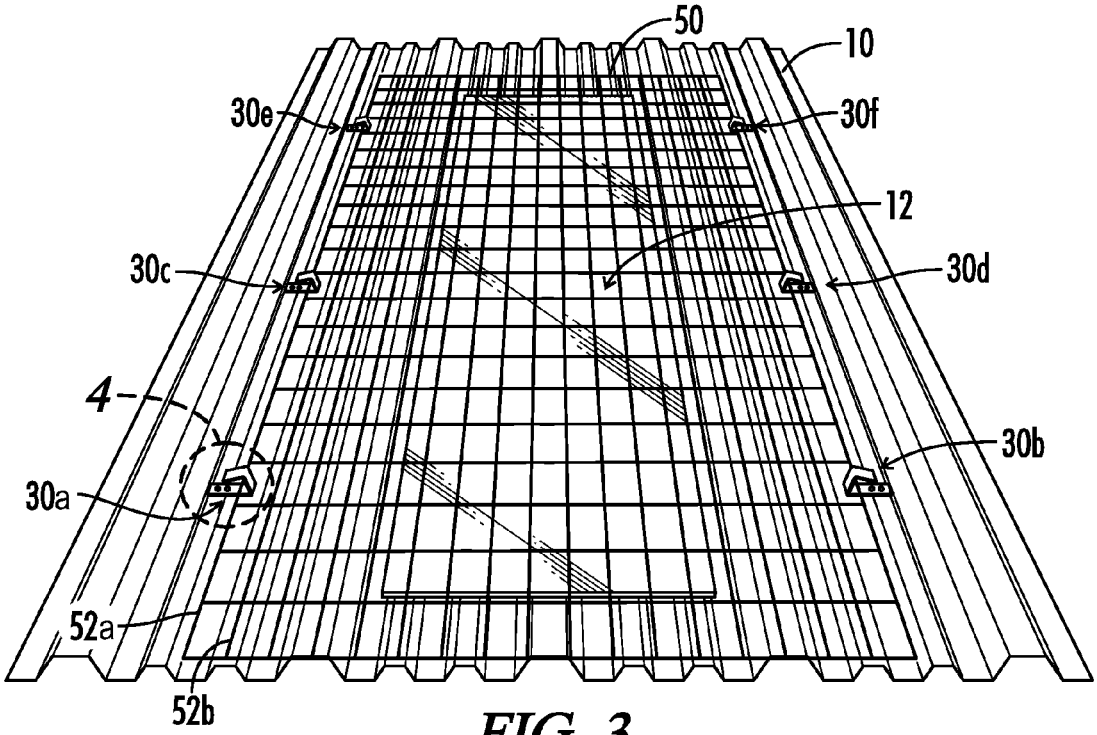
FIG. 3 illustrates a perspective view of the embodiment of a skylight guard of FIG. 2 positioned over a skylight in accordance with the present disclosure.

Referring further to FIG. 2, a plurality of hooks 30*a*, 30*b*, 30*c*, 30*d*, etc. secure screen 50 to roof 10. Each hook generally engages a longitudinal wire strand on screen 50. In some embodiments, each hook engages the outermost longitudinal wire strand on opposing edges of screen 50, as seen in FIG. 2. In other embodiments, one or both hooks can engage an interior longitudinal wire strand. For example, as seen in FIG. 3, first hook 30*a* engages second longitudinal wire strand 52*b*. In such embodiments, first hook 30*a* can remain engaged with screen 50 via first longitudinal wire strand 52*a* even if second longitudinal wire strand 52*b* becomes locally detached from one or more lateral wire strands. In other embodiments, as seen in FIG. 4, first hook 30*a* engages an outermost longitudinal wire strand 52*a*.

In the event that a person or object is positioned on the screen 50, the hooks will prevent the screen from deflecting to an extent that would allow the person or object to fall through skylight 12.

Figure 4:
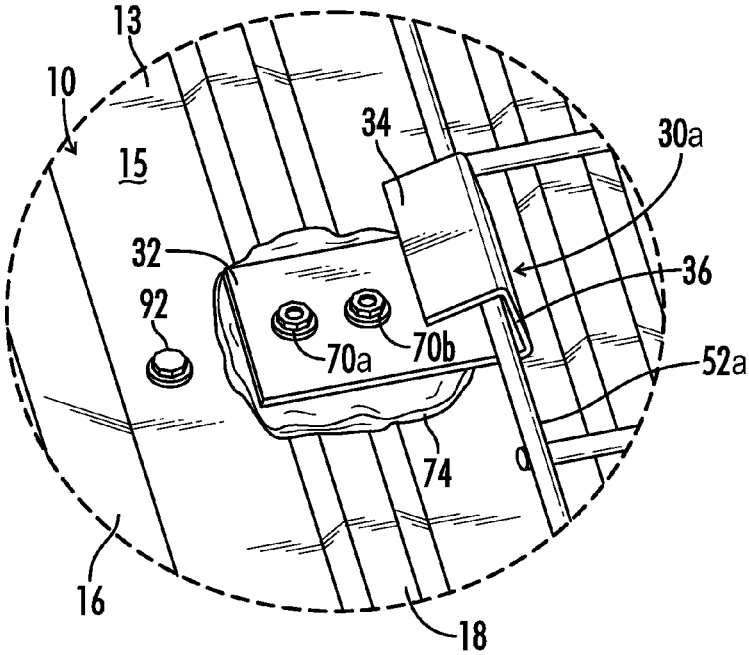
FIG. 4 illustrates a detail perspective view of an embodiment of a hook of the skylight guard apparatus of Section 4 from FIG. 3.

Referring now to FIG. 4, in some embodiments, each hook 30 includes a hook base 32 that is mechanically securable to the roof 10. First hook 30*a* is illustrated in FIG. 4, but it is understood that other hooks 30*b*, 30*c*, 30*d*, etc. share a similar configuration as first hook 30*a*. Hook base 32 can include a substantially flat plate in some embodiments. Hook base 32 can be formed to fully or partially correspond to a corrugation in the roof 10 in some other embodiments. Hook base 32 includes a hook wall 36 extending upward from the hook base 32. A hook flange 34 extends from the hook wall 36 in a direction generally away from screen 50. In some embodiments, a mastic material 74 such as a weatherproofing strip, putty or gel can be positioned between roof 10 and hook base 32. As seen in FIG. 4, a first one of the plurality of longitudinal wire strands 52*a* is received in the first hook 30*a* between the hook base 32 and the hook flange 34. Also seen in FIG. 4, in some embodiments, roof 10 includes a secondary corrugation 18 extending a distance above roof panel surface 15 less than the height of a primary corrugation 16. In some embodiments, hook 30 is positioned on a secondary corrugation 18.

Referring again to FIG. 2 and FIG. 3, in some embodiments, a second hook 30*b* is provided. The second hook 30*b* is mechanically securable to the roof 10. Second hook 30*b* can include the same form as first hook 30*a*, and includes a second hook base, a second hook wall extending upward from the second hook base, and a second hook flange extending from the second hook wall in a direction generally away from the first hook 30*a*. A second one of the plurality of longitudinal wire strands is received in second hook 30*b* between second hook flange and second hook base. The longitudinal wire strand received in second hook 30*b* can include a wire on the outer perimeter of screen 50 or an interior longitudinal wire. Second hook 30*b* is generally disposed on or near second screen longitudinal edge 56*b*.

In some embodiments, first and second hooks 30*a*, 30*b* are longitudinally aligned with a lateral edge 28*a* of skylight 12, as seen in FIG. 2. Similarly, fifth and sixth hooks 30*e*, 30*f* can be longitudinally aligned with second lateral edge 28*b* of skylight 12.

Figure 5:
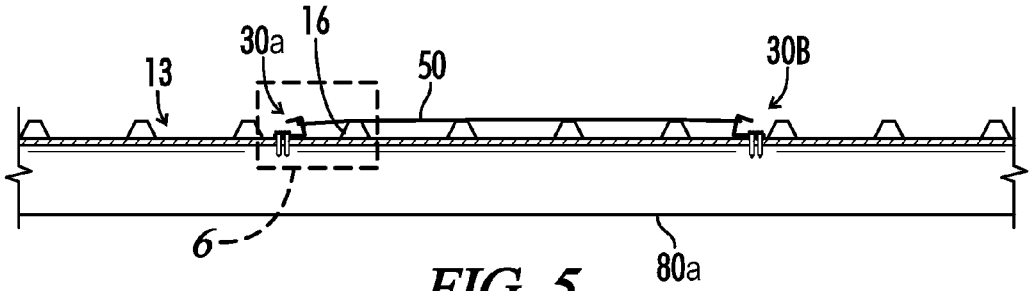
FIG. 5 illustrates a cross-sectional view of an embodiment of a skylight guard apparatus showing Section 5-5 from FIG. 2.

Referring now to FIG. 9, in some embodiments, roof 10 includes a roof panel surface 15. A first corrugation 16 protrudes upward from the roof panel surface 15 between the first hook 30*a* and the skylight 12. In some embodiments, the screen 50 contacts the first corrugation 16. For example, as seen in FIG. 5, screen 50 is positioned on roof panel 13 such that screen 50 contacts roof corrugation 16. As seen in more detail in FIG. 6, first corrugation 16 is positioned between first hook 30*a* and skylight 12. In this embodiment, a plurality of lateral wire strands 54*a*, 54*b*, 54*c*, etc. rest against first corrugation 16, seen in FIG. 9. Thus, when a load is placed on screen 50 over skylight 12, first corrugation 16 acts as a supporting structure for lateral wire strands 54. As such, lateral wire strands 54 can apply a tensile force vector against first hook 30*a* that extends primarily in the lateral and longitudinal directions during downward loading of screen 50.

Figure 6:
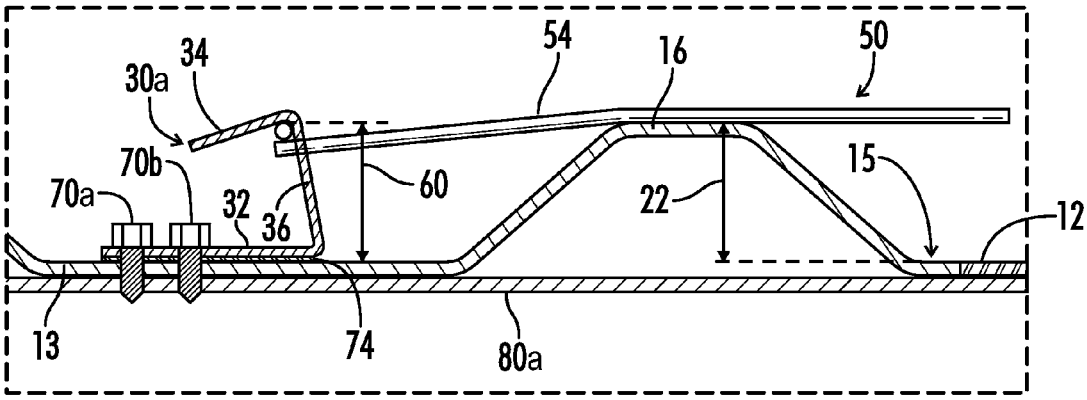
FIG. 6 illustrates a detail cross-sectional view of an embodiment of a hook apparatus of the skylight guard apparatus of Section 6 from FIG. 5.
Figure 8:
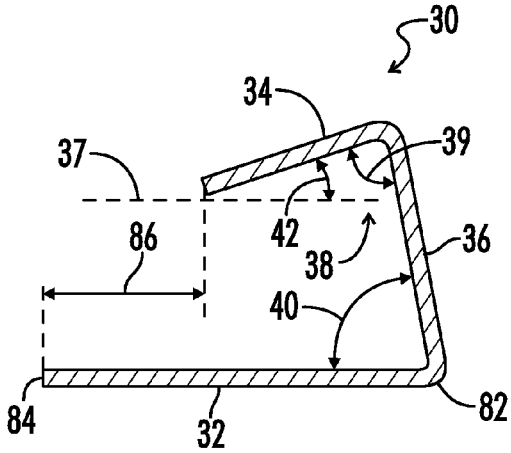
FIG. 8 illustrates an elevation cross-sectional view of an embodiment of a hook apparatus in accordance with the present disclosure.

Referring further to FIG. 6, in some embodiments, the first corrugation 16 defines a first corrugation height 22 extending from the roof panel surface 15 to the top of the first corrugation 16. Referring to FIG. 8, each hook 30 includes an interior flange corner 38 defined between the hook flange 34 and the hook wall 36. Each hook 30 defines a flange corner height 60, seen in FIG. 6. In some embodiments, the flange corner height 60 of first hook 30*a* is no greater than the first corrugation height 22 when the first hook 30*a* is secured to the roof 10. In some embodiments, the flange corner height 60 is less than the first corrugation height 22 when the first hook 30*a* is secured to the roof. In some embodiments, the dimensional relationship between a flange corner height 60 and a nearby corrugation height 22 can allow each hook to secure wire screen 50 against a nearby corrugation to prevent screen 50 from shifting during use.

Referring again to FIG. 8, in some embodiments, a hook 30 in accordance with the present disclosure provides a combination of acute angles. A hook wall angle 40 is defined between hook base 32 and hook wall 36. A hook flange angle 42 is defined between hook flange 34 and a base reference axis 37 aligned substantially parallel to hook base 32. In some embodiments, base reference axis 37 is oriented along the x-axis seen in FIG. 2. Additionally, an interior flange corner angle 39 is defined between hook flange 34 and hook wall 36. In some embodiments, the hook wall 36 is oriented at an acute angle relative to the hook base 32, i.e. the hook wall angle 40 is less than about ninety degrees in some embodiments. In further embodiments, the hook flange 34 is oriented at an acute angle relative to base reference axis 37, i.e. hook flange angle 42 is less than about ninety degrees. In some embodiments, interior flange corner angle 39 is also acute. In further embodiments, interior flange corner angle 39 can be substantially equal to ninety degrees.

The hook base 32 has a first base edge 82 and an opposite second base edge 84. The hook wall 36 extends upward from the first base edge 82. The hook flange 34 extends from the hook wall 36 generally in a direction toward second base edge 84 above the hook base 32, as seen in FIG. 8. A hook base offset includes a region of hook base 32 extending a hook base offset distance 86 beyond hook flange 34 in a direction away from first base edge 82.

In some embodiments, each hook 30 can include a galvanized metal plate having a thickness of about one-eighth inch and a width of about two inches. The plate can be bent in at least two locations to form hook wall 36 and hook flange 34.

Each hook 30 can be secured to roof 10 using one or more hook fasteners 70, as seen in FIGS. 4, 6 and 9. Each hook fastener 70 is generally inserted into a fastener hole 72 defined in hook base 32. Each fastener 70 in some embodiments includes a self-tapping screw that can be installed directly into the metal roof panel. In some embodiments, a first fastener 70*a* is installed in a first fastener hole 72*a*, and a second fastener 70*b* is installed in a second fastener hole 72*b*. Second fastener hole 72*b* can be formed on hook base offset to allow the fastener to be inserted from above without interfering with hook flange 34.

Referring again to FIG. 2, in some embodiments, a roof support structure, or purlin 80, is positioned under roof 10. A plurality of purlins 80*a*, 80*b*, 80*c*, etc. can extend under a roof 10 and also under a skylight 12. Each purlin can form a conventional purlin structure known in the art such as a C-purlin or a Z-purlin. Each purlin generally includes an upper purlin flange or upper purlin surface supporting roof panel 13. In some embodiment, a first purlin 80*a* extends under roof 10 directly below first and second hooks 30*a*, 30*b*. Each first and second hook 30*a*, 30*b* can be secured to first purlin 80*a* using hook fasteners 72. For example, as seen in FIG. 6, one or more hook fasteners 70*a*, 70*b* can extend through the hook base 32, through the roof panel 13, and into the first purlin 80*a*. Thus, first hook 30*a* is mechanically anchored to the first purlin 80*a*. Similarly, second hook 30*b* can also be secured to first purlin 80*a* opposite first hook 30*a* using additional hook fasteners. By securing first and second hooks, 30*a*, 30*b* to the first purlin 80*a*, a tensile load applied between first and second hooks 30*a*, 30*b* will be distributed partially through the first purlin 80*a*. As such, the first purlin 30*a* reinforces screen 50 extending between first and second hooks 30*a*, 30*b* when a downward load is applied to screen 50.

Also seen in FIG. 2, a second purlin 80*b* can extend under roof panel 13 supporting roof panel 13 and skylight 12. Third hook 30*c* and fourth hook 30*d* can be secured to second purlin 80*b* using hook fasteners on opposite longitudinal sides of screen 50. Further, a third purlin 80*c* can extend under roof panel 13 supporting roof panel 13 and skylight 12. Fifth hook 30*e* and sixth hook 30*f* can be secured to third purlin 80*c* using hook fasteners on opposite longitudinal sides of screen 50.

Referring further to FIG. 4, in some embodiments, a panel fastener 92 is disposed on roof panel 13 adjacent a hook 30. Panel fastener 92 can include a threaded fastener extending through roof panel 13 into a supporting purlin. The panel fastener 92 can be secured to the same purlin that the nearby hook 30 is secured to. Thus, panel fastener 92 provides additional strength to hook 30 and screen 50 when a tensile load is applied against hook 30 due to downward loading of screen 50.

One aspect of the present disclosure provides a screen 50 compliant with standards promulgated by the Occupational Safety & Health Administration (OSHA) for guarding skylights. In some embodiments, the screen 50 provides a screen of such construction and mounting so that the screen 50 is capable of withstanding a load of at least two-hundred points applied perpendicularly at any one area on the screen 50. The screen 50 in some embodiments can be loaded in tension between opposing hooks 30*a*, 30*b* such that the screen 50 will not deflect downward sufficiently to break the panel 14 below the screen 50.

As seen in FIG. 9, in some embodiments, screen 50 includes a plurality of lateral strands 54*a*, 54*b*, 54*c*, etc. and a plurality of longitudinal strands 52*a*, 52*b*, 52*c*, etc. forming a grid pattern. In some embodiments, the plurality of lateral strands 54*a*, 54*b*, 54*c*, etc. are oriented substantially transverse to one or more roof corrugations 16. As such, when a load is applied downward against screen 50, a compressive load is applied between longitudinal strands 52*a*, 52*b*, 52*c*, etc. and lateral strands 54*a*, 54*b*, 54*c*, etc. Additionally, in some embodiments, first and second hooks both engage screen 50 between the same two lateral strands on opposite sides of the screen 50. For example, first hook 30*a* engages screen 50 between first and second lateral strands 54*a*, 54*b* on first screen longitudinal edge 56*a*, as seen in FIG. 9. Similarly, a second hook 30*b* engages screen 50 also between first and second lateral strands 54*a*, 54*b* on second screen longitudinal edge 56*b*, as seen in FIG. 2. Referring again to FIG. 9, in some embodiments, the longitudinal spacing 78 between adjacent lateral wire strands is no greater than about four inches. Similarly, in some embodiments, a lateral spacing distance 76 is defined between adjacent longitudinal wire strands 52*a*, 52*b*, 52*c*, etc. The lateral spacing distance 76 between at least two adjacent longitudinal wire strands 52*a*, 52*b*, 52*c*, etc. is no greater than about four inches. Thus, both the lateral spacing distance 76 and the longitudinal spacing distance 78 between adjacent longitudinal and lateral wire strands are no greater than about four inches in some embodiments.

Thus, although there have been described particular embodiments of the present invention of a new and useful SKYLIGHT GUARD, it is not intended that such references be construed as limitations upon the scope of the invention except as set forth in the following claims.

What is claimed is:

1. An apparatus for covering a skylight on a roof, the roof including a roof panel and a roof panel surface, the roof defining an opening and the skylight spanning the opening, the apparatus comprising:

a wire mesh screen having a plurality of longitudinal wire strands, the screen being positioned above the skylight;

a first hook including a first hook base securable to the roof, the first hook including a first hook wall extending upward from the first hook base and a first hook flange extending from the first hook wall in a direction generally away from the screen;

a second hook including a second hook base securable to the roof, the second hook including a second hook wall extending upward from the second hook base and a second hook flange extending from the second hook wall in a direction generally away from the first hook;

a first purlin supporting the roof panel, wherein the first hook is aligned with the first purlin; and a first fastener configured to extend from the first hook into the first purlin, wherein a first one of the plurality of longitudinal wire strands is received in the first hook between the first hook base and the first hook flange and a second one of the plurality of longitudinal wire strands is received in the second hook between the second hook base and the second hook flange.

2. The apparatus of claim 1, further comprising:

the second hook aligned with the first purlin; and a second fastener configured to extend from the second hook into the first purlin.

3. The apparatus of claim 2, further comprising:

a third hook attached to the roof on the same side of the skylight as the first hook;

a fourth hook attached to the roof on the same side of the skylight as the second hook; and a second purlin supporting the roof panel, wherein the third and fourth hooks are secured to the second purlin.

4. The apparatus of claim 3, further comprising:

a fifth hook attached to the roof on the same side of the skylight as the first and third hooks;

a sixth hook attached to the roof on the same side of the skylight as the second and fourth hooks; and a third purlin supporting the roof panel, wherein the fifth and sixth hooks are secured to the third purlin.

5. The apparatus of claim 3, further comprising:

a third fastener extending from the third hook into the second purlin; and a fourth fastener extending from the fourth hook into the second purlin.

* * * * *